US007990405B2

(12) United States Patent
Fukumoto

(10) Patent No.: US 7,990,405 B2
(45) Date of Patent: Aug. 2, 2011

(54) THERMAL HEAD AND THERMAL PRINTER

(75) Inventor: Yoshihiko Fukumoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 12/546,190

(22) Filed: Aug. 24, 2009

(65) Prior Publication Data

US 2010/0053294 A1 Mar. 4, 2010

(30) Foreign Application Priority Data

Aug. 29, 2008 (JP) ..... 2008-221674

(51) Int. Cl.
*B41J 2/335* (2006.01)

(52) U.S. Cl. ..... 347/202

(58) Field of Classification Search ..... 347/200, 347/201, 202, 203, 207
See application file for complete search history.

(56) References Cited

U.S. PATENT DOCUMENTS

| | | | | |
|---|---|---|---|---|
| 4,587,399 | A * | 5/1986 | Higeta et al. | 347/207 |
| 5,021,806 | A * | 6/1991 | Sugiyama | 347/207 |
| 5,095,318 | A * | 3/1992 | Sugiyama | 347/207 |
| 2003/0103112 | A1* | 6/2003 | Shirakawa et al. | 347/64 |
| 2004/0212669 | A1* | 10/2004 | Shirakawa et al. | 347/200 |

FOREIGN PATENT DOCUMENTS

| | | | |
|---|---|---|---|
| JP | 60-72752 | * | 4/1985 |
| JP | 60-112462 | | 6/1985 |
| JP | 2-137943 | | 5/1990 |
| JP | 6-320769 | | 11/1994 |
| JP | 63-20769 | | 11/1994 |
| JP | 7-227968 | * | 8/1995 |
| JP | 9-201994 | * | 8/1997 |
| JP | 2002-254686 | | 9/2002 |

* cited by examiner

*Primary Examiner* — Huan H Tran
(74) *Attorney, Agent, or Firm* — Fitzpatrick, Cella, Harper & Scinto

(57) ABSTRACT

A thermal head is provided with increased contact pressure between a heat generating portion and a printing medium to increase printing quality with a low heat loss. The thermal head includes: a plurality of heat generating resistors formed via an insulating layer; a driver circuit unit for driving the plurality of heat generating resistors to generate a heat; a wiring for connecting the driver circuit unit to the plurality of heat generating resistors; a protecting film formed to cover the plurality of heat generating resistors, the driver circuit unit and the wiring. The plurality of heat generating resistors, the driver circuit unit, the wiring and the protecting film are formed on a substrate. A thermal insulating layer having a thermal conductivity smaller than 0.5 W/m·K and having a maximum thickness of larger than 10 μm is provided between the heat generating resistor and the substrate.

9 Claims, 4 Drawing Sheets

THERMAL HEAD AND THERMAL PRINTER

BACKGROUND OF THE INVENTION

1. Field of the Invention

The present invention relates to a thermal head and a thermal printer, and more particularly to a thermal head and a thermal printer using a single crystalline silicon substrate.

2. Description of the Related Art

In recent years, thermal heads for performing thermosensitive recording by selective heat generation of a heat generating element have been used.

Japanese Patent Application Laid-Open Nos. H02-137943 and H06-320769 disclose a thermal head using a single crystalline silicon substrate.

The thermal head disclosed in Japanese Patent Application Laid-Open Nos. H02-137943 and H06-320769 includes: a heat generating element formed on a single crystalline silicon substrate via an insulating film; a driver circuit unit formed on the single crystalline silicon substrate; a wiring layer for connecting the driver circuit unit to the heat generating element; and a protecting film for protecting a thermal head surface.

A heat generating resistor protrudes toward a printing medium for increasing contact pressure with a printing medium such as thermal paper or an ink sheet to increase printing efficiency.

Proposed methods therefor include a method of partially etching a silicon substrate to form a protruding portion and forming a heat generating portion on the protruding portion, and a method of forming a silicon oxide film having a thickness of several μm on a silicon substrate, then forming a protruding shape on the silicon oxide film by patterning, and forming a heat generating portion on the protruding portion.

In the structure in which a heat generating resistor is disposed on the protruding portion formed by partially etching the silicon substrate of the conventional techniques described above, the heat generating resistor is located near the silicon substrate having a large thermal conductivity of 152 W/m·K. Thus, thermal energy generated by the heat generating resistor easily escapes toward the silicon substrate to increase heat loss and thus increase power consumption.

In the structure in which the silicon oxide film is formed into a protruding shape, the limit of a height of the protruding portion is several μm due to the limit of stress, and thus sufficient contact pressure with the printing medium cannot be obtained and clear image quality cannot be obtained in some cases.

The present invention has an object to provide a thermal head that increases contact pressure between a heat generating portion and a printing medium to increase printing quality with a low heat loss.

SUMMARY OF THE INVENTION

In order to achieve the above described object, the present invention provides a thermal head including: a plurality of heat generating resistors; a driver circuit unit for driving the plurality of heat generating resistors to generate heat; a wiring for connecting the driver circuit unit to the plurality of heat generating resistors; and a passivation film formed to cover the plurality of heat generating resistors, the driver circuit unit and the wiring. The plurality of heat generating resistors, the driver circuit unit, the wiring and the protecting film are formed on a common semiconductor substrate. A silicon oxide film is arranged between the heat generating resistor and the semiconductor substrate, and a thermal insulating layer having a thermal conductivity smaller than that of the silicon oxide film and having a shape protruding from the substrate toward the heat generating resistor is arranged between the heat generating resistor and the silicon oxide film.

Further features of the present invention will become apparent from the following description of exemplary embodiments with reference to the attached drawings.

DESCRIPTION OF THE EMBODIMENTS

Now, exemplary embodiments for carrying out the present invention will be described with reference to the accompanying drawings.

The accompanying drawings, which are incorporated in and constitute a part of the specification, illustrate embodiments of the invention and, together with the description, serve to explain the principles of the invention.

First Embodiment

Figure 1:
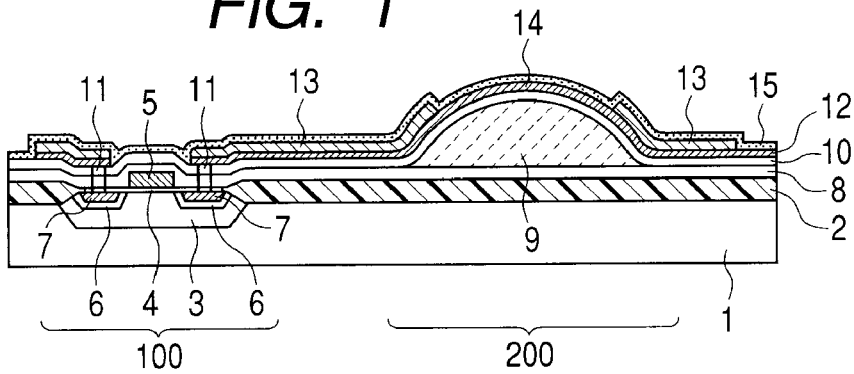
FIG. 1 is a sectional view of a configuration of a thermal head according to a first embodiment of the present invention.

FIG. 1 is a sectional view of a configuration of a thermal head according to a first embodiment of the present invention.

FIG. 1 shows a single crystalline silicon substrate 1, a field oxide film 2, a p-type well 3, a gate oxide film 4, a gate electrode 5, an n-type field relief region 6, n-type source and drain regions 7, an interlayer film 8 and a thermal insulating layer 9. Also shown are an interlayer film 10, a contact plug 11, a heat generating resistor material layer 12, a wiring 13, a heat generating resistor 14 and a protecting film 15. The heat generating resistor 14 refers to a portion on which the wiring 13 is not formed on the heat generating resistor material layer 12. The interlayer film 10 is an insulating layer provided on the thermal insulating layer 9.

The heat generating resistor 14 is formed from TaSiN, and provided on the single crystalline silicon substrate 1 via the field oxide film 2, the $SiO_2$-based interlayer film 8, the thermal insulating layer 9 and the $SiO_2$-based or $Si_3N_4$-based interlayer film 10.

The heat generating resistor 14 may be formed from a high resistance material such as a Ta-based compound, a W-based compound, a Cr-based compound or an Ru-based compound, as well as TaSiN.

In this embodiment, the single crystalline silicon substrate is used as a substrate, but any substrates on which general semiconductor devices can be formed may be used. Specifically, an insulator substrate on which a polysilicon TFT is formed in a thin film process or a GaAs substrate may be used.

A driver circuit unit 100 for applying a desired voltage and current to the heat generating resistor 14 is formed on a surface of the single crystalline silicon substrate 1. The driver circuit unit 100 includes a MOS transistor. The MOS transistor includes the p-type well 3 formed by ion implantation and heat treatment, the gate oxide film 4, the gate electrode 5, the n-type field relief region 6 and the n-type source and drain regions 7.

The case where the driver circuit unit 100 includes an n-type MOS transistor is herein illustrated, but the driver circuit unit 100 may include a p-type MOS transistor or a CMOS transistor. An example of an offset MOS transistor configuration is herein illustrated, but a DMOS (Double Diffused MOS) transistor configuration may be used. The offset MOS transistor has a configuration in which a semiconductor region (the field relief region 6 in FIG. 1) having a low concentration is arranged near a gate electrode of source and drain regions.

The heat generating resistor 14 is connected to the source or drain region of the MOS transistor included in the driver circuit unit 100 by the wiring 13 of Al alloy and the contact plug 11 arranged in a contact hole.

An example of the wiring 13 in one layer is illustrated, but a wiring in a plurality of layers may be used.

The heat generating resistor 14 is formed by the following method.

Specifically, the heat generating resistor material layer that constitutes the heat generating resistor 14 and a wiring material layer that constitutes the wiring 13 are formed in a laminated manner, and then the wiring material layer and the heat generating resistor material 12 are simultaneously patterned to form a desired wiring pattern by photolithography and dry etching.

A region other than a heat generating portion (a heat generating resistor forming portion) on the wiring material layer is covered with photoresist by photolithography again, and for example, a phosphate-based etching liquid is used to selectively remove the wiring material layer by etching and expose the heat generating resistor material layer.

The protecting film 15 is formed to cover the entire surface of the thermal head including the heat generating resistor 14, the wiring 13 and the driver circuit unit 100. The protecting film 15 requires durability for reliability, so that the protecting film 15 has appropriate insulating properties and moisture resistance, and thus a hard insulating film of $Si_3N_4$ or the like can be used. The portion from which the wiring material layer is removed on the heat generating resistor material layer is the heat generating resistor 14.

As noted above, the protecting film 15 requires durability for reliability, so that the protecting film 15 has insulating properties and moisture resistance and is repeatedly heated and cooled. Thus, an insulating film of $SiO_2$, $Si_3N_4$ or the like that is chemically and thermally stable and has abrasion resistance can be used.

The heat generating resistor 14, the driver circuit unit 100, and the wiring 13 for connecting the driver circuit unit to the heat generating resistor and the protecting film 15 are formed on the common substrate 1.

In this embodiment, the thermal insulating layer 9, having a maximum thickness of larger than 10 μm and a thermal conductivity smaller than 0.5 W/m·K, is provided between the heat generating resistor 14 and the single crystalline silicon substrate 1. The thermal insulating layer is arranged between the heat generating resistor and a silicon oxide film. The field oxide film 2 and the $SiO_2$-based interlayer film 8 correspond to the silicon oxide film. The thermal insulating layer has a shape protruding from the substrate toward the heat generating resistor.

The thermal insulating layer 9 needs to have a thickness larger than a thickness of several μm of a step in a transistor portion below the thermal insulating layer 9 for increasing the contact pressure between a heat generating resistor unit and a printing medium. A thicker thermal insulating layer has a higher thermal insulation effect, and thus, the thermal insulating layer 9 can have a thickness of larger than 10 μm at the protruding shape. An upper limit of the thickness of the protruding shape can be 100 μm for a coverage characteristic.

The thermal insulating layer 9 desirably has a thermal conductivity smaller than that of the protecting film 15 in terms of thermal efficiency.

$SiO_2$ suitable for the protecting film 15 has a thermal conductivity of about 0.7 W/m·K and $Si_3N_4$ has a thermal conductivity of about 16 W/m·K. Thus, the thermal insulating layer 9 can be formed from a material having a thermal conductivity smaller than 0.5 W/m·K that is smaller than that of $SiO_2$. As well as $SiO_2$, organic matter generally used as a protecting film in this field have a thermal conductivity substantially equal to or larger than that of $SiO_2$, and when such a protecting film is used, the thermal insulating layer 9 can also be formed from a material having a thermal conductivity smaller than 0.5 W/m·K.

For example, the thermal insulating layer 9 is suitably formed from polyimide resin having a thermal conductivity of about 0.15 W/m·K. Alternatively, the thermal insulating layer 9 may be formed from an organic resin material or an organic-inorganic hybrid material may be used.

In this embodiment, the thermal insulating layer 9 has a sectional area shaped to form at least one curve-shaped portion.

The thermal insulating layer 9 has a columnar shape with a semicircular section, but is not limited to such a shape, and for example, may have a barrel shape or a trapezoidal columnar shape.

A specific forming method will be described below.

First, an element such as a transistor is formed on the single crystalline silicon substrate 1, and then the $SiO_2$-based interlayer film 8 is formed.

Photosensitive polyimide is applied on the interlayer film 8 to a desired thickness, and is patterned into a desired pattern by photolithography.

For example, photosensitive polyimide is applied to a thickness of 50 μm and exposed by an i-line exposure apparatus, and then developed with a special solvent developer to form a desired pattern.

Then, a solvent in the polyimide is removed by drying at 60° C. for 30 minutes, and then the polyimide is reacted and cured by heat treatment at 200° C. for 60 minutes and further at 420° C. for 60 minutes to form the thermal insulating layer 9.

In the heat treatment in the forming step, a gentle curvature is formed on an edge and an upper surface of the polyimide pattern after development to provide a sectional area effective for prevention of a break of the wiring 13 formed thereon and contact with a printing medium.

As another forming method, a desired pattern may be drawn with a polyimide resin solvent using a dispenser.

In this case, a surface tension effect of the polyimide resin solvent provides the thermal insulating layer 9 with an arcuate sectional area, and a gentle curvature is also formed at an edge by heat treatment.

This provides a sectional area effective for prevention of a break of the wiring 13 and contact with a printing medium.

The $SiO_2$-based or $SiN_4$-based interlayer film 10 is formed to cover the thermal insulating layer 9 formed as described above, then a contact hole is opened, and then the wiring 13 is formed and the heat generating resistor is formed by the above described method.

Finally, the protecting film 15 of $SiO_2$ or $Si_3N_4$ is formed.

In this embodiment, the thermal insulating layer 9 is sandwiched between a plurality of insulating layers. Among the insulating layers, the interlayer film 10 sandwiched between the heat generating resistor 14 and the thermal insulating layer 9 is not essential. However, in order to prevent the influence of a thermal insulating layer material on resistivity changes of the heat generating resistor 14, a layer of $SiO_2$, $Si_3N_4$ or the like that is chemically and thermally stable can be disposed for reliability.

Figure 2:
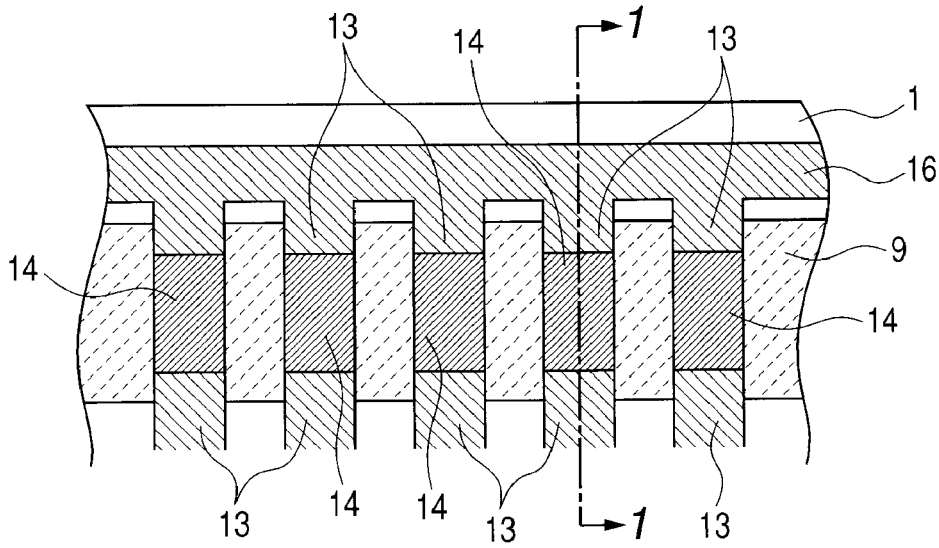
FIG. 2 is a top plan view of a heat generating resistor unit of the thermal head according to the first embodiment of the present invention.

FIG. 2 is a top plan view of a heat generating resistor unit of the thermal head according to this embodiment. The section taken along the line 1-1 in FIG. 2 corresponds to the heat generating resistor unit in FIG. 1.

Heat generating resistors 14 are disposed at desired intervals on a linearly patterned thermal insulating layer 9 via an interlayer film (not shown). One end of each heat generating resistor 14 is connected to a wiring 13 connecting to a common electrode 16, and the other end is connected to a wiring 13 connecting to a driver circuit unit (not shown).

An example is herein illustrated in which the common electrode 16 and the driver circuit unit (not shown) are disposed on opposite sides of the thermal insulating layer 9, but the heat generating resistor 14 or the wiring 13 may be folded back so that the common electrode 16 and the driver circuit unit are disposed on one side of the thermal insulating layer 9.

With the above described configuration, the amount of protrusion of the heat generating resistor 14 from the single crystalline silicon substrate 1 can be increased to increase contact pressure of the protecting film 15 on the heat generating resistor 14 with the printing medium. This can improve printing efficiency and quality.

The thermal insulating layer 9 having a maximum thickness of larger than 10 μm is provided between the single crystalline silicon substrate 1 having a large thermal conductivity and the heat generating resistor 14, thereby preventing thermal energy generated by the heat generating resistor 14 from flowing to the single crystalline silicon substrate 1. This can reduce power consumption.

Second Embodiment

Figure 3:
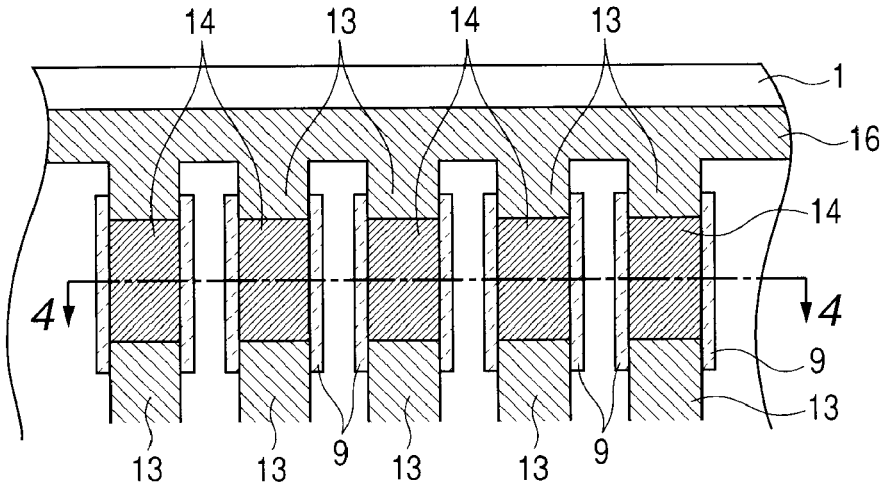
FIG. 3 is a top plan view of a heat generating resistor unit of a thermal head according to a second embodiment of the present invention.
Figure 4:
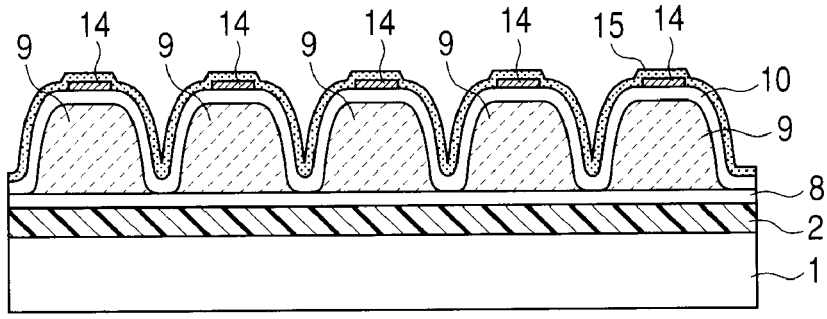
FIG. 4 is a sectional view taken along the line 4-4 in FIG. 3.

FIG. 3 is a top plan view of a heat generating resistor unit of a thermal head according to a second embodiment of the present invention. FIG. 4 is a sectional view taken along the line 4-4 in FIG. 3.

A thermal insulating layer 9 is herein formed in an island shape, and a heat generating resistor 14 is disposed on each thermal insulating layer 9 via an interlayer film 10. The thermal insulating layer 9 can be formed by photolithography because fine patterning is required.

For example, photosensitive polyimide is applied to a thickness of 50 μm and exposed by an i-line exposure apparatus, and then developed with a special solvent developer to form a desired pattern.

Then, a solvent in the polyimide is removed by drying at 60° C. for 30 minutes, and then the polyimide is reacted and cured by heat treatment at 200° C. for 60 minutes and further at 420° C. for 60 minutes to form the thermal insulating layer 9.

In the heat treatment in the forming step, a gentle curvature is formed on an edge and an upper surface end of the polyimide pattern after development to provide a sectional area effective for prevention of a break of the wiring 13 formed thereon and contact with a printing medium.

Adjacent thermal insulating layers 9 are herein separated, and the thermal insulating layer 9 is not disposed in a gap between the heat generating resistors 14.

Figure 5:
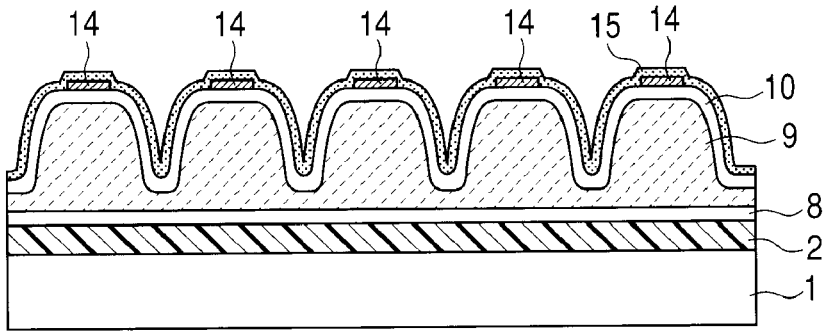
FIG. 5 is a sectional view of another configuration of a thermal head according to the second embodiment of the present invention.

As shown in FIG. 5, it is allowed that the thermal insulating layer 9 is not separated, and the thickness of the thermal insulating layer 9 disposed in the gap between adjacent heat generating resistors 14 is smaller than the thickness of the thermal insulating layer 9 at just under the heat generating resistors 14.

For example, this shape can be obtained by setting the exposure to be an under exposure when the photosensitive polyimide is exposed. Further, the exposure amount can be adjusted to control the difference in thickness between the thermal insulating layer 9 just under the heat generating resistors 14 and the thermal insulating layer 9 disposed in the gap.

Alternatively, in the forming step of the wiring 13 by etching, a structure may also be formed in which the thermal insulating layer 9 is separated by over-etching.

One end of each heat generating resistor 14 is connected to the wiring 13 connecting to a common electrode 16, and the other end is connected to the wiring 13 connecting to the driver circuit unit (not shown).

An example is herein illustrated in which the common electrode 16 and the driver circuit unit (not shown) are disposed on opposite sides of the thermal insulating layer 9, but the heat generating resistor 14 or the wiring 13 may be folded back so that the common electrode 16 and the driver circuit unit are disposed on one side of the thermal insulating layer 9.

In this embodiment, the thermal insulating layer 9 is not disposed in the gap between the adjacent heat generating resistors 14, or the thickness of the thermal insulating layer 9 disposed in the gap is smaller than the thickness of the thermal insulating layer 9 at just under the heat generating resistors 14.

With this structure, the protecting film 15 on the heat generating resistor 14 is firmly pressed against the printing medium to improve printing efficiency, reduce power consumption and increase printing speed.

Further, in joining a plurality of short sized thermal heads to form a long sized thermal head, the margin of alignment accuracy of a joint portion in a height direction can be increased to reduce cost for the long sized thermal head.

Figure 6:
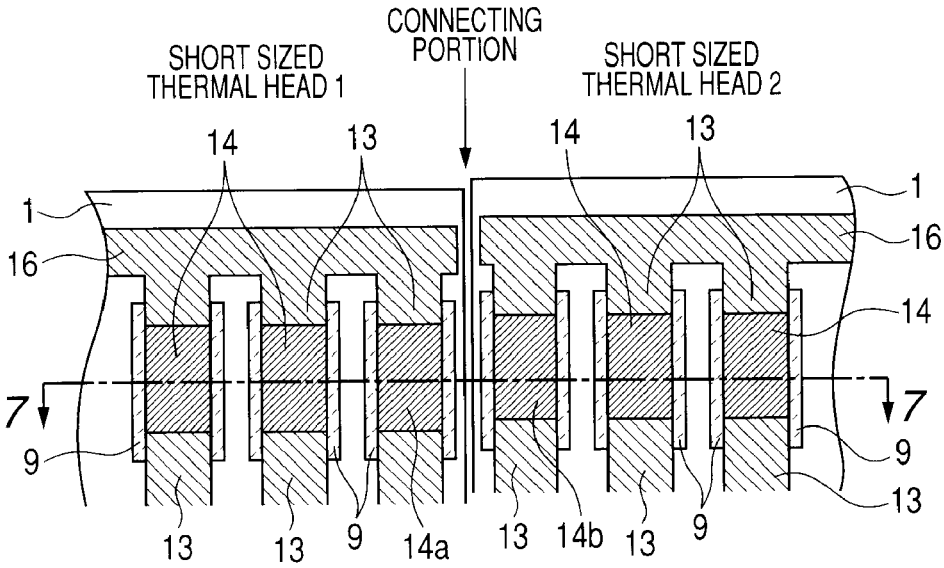
FIG. 6 is a plan view of a joint portion of a long sized thermal head comprising a plurality of thermal heads joined together according to the second embodiment of the present invention.
Figure 7:
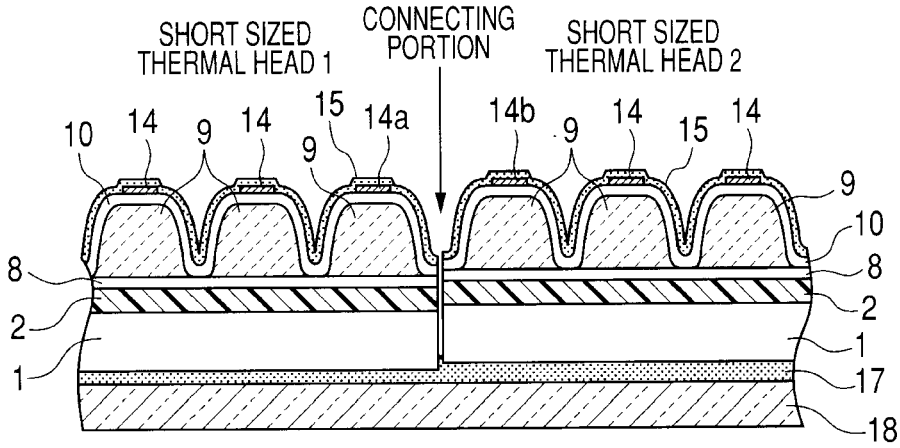
FIG. 7 is a sectional view taken along the line 7-7 in FIG. 6.

FIG. 6 is a plan view of a joint portion of a long sized thermal head comprising a plurality of thermal heads joined together according to this embodiment. FIG. 7 is a sectional view taken along the line 7-7 in FIG. 6.

The short sized thermal heads are arranged with an adhesive 17 on a heat sink 18 of, for example, Al.

In this case, the short sized thermal heads need to be disposed with high alignment accuracy. Particularly, adjacent heat generating resistors 14*a* and 14*b* at a joint portion need to be disposed with high accuracy in a height direction for equal contact pressure with the printing medium.

The thermal head according to this embodiment has a structure in which the heat generating resistor 14 can protrude by a distance larger than 10 μm from its surroundings, thereby allowing the margin of alignment accuracy of sections in the height direction to be increased.

Third Embodiment

Figure 8:
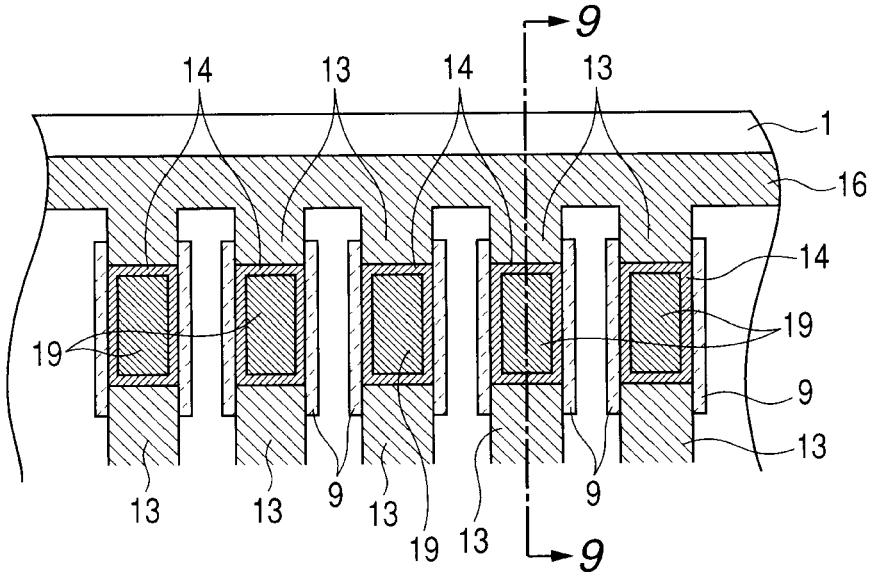
FIG. 8 is a top plan view of a heat generating resistor unit of a thermal head according to a third embodiment of the present invention.
Figure 9:
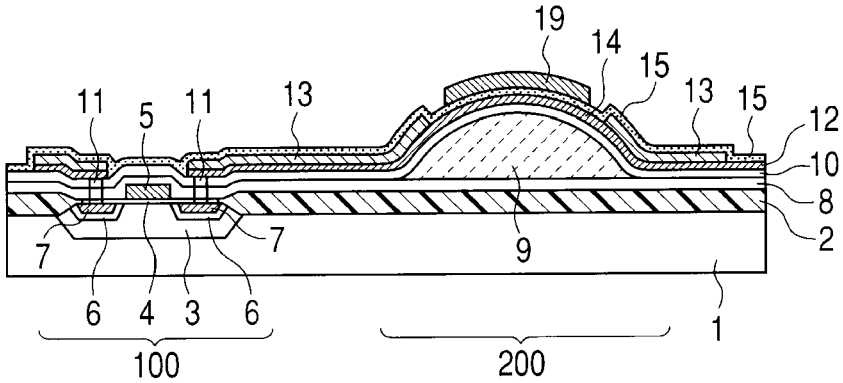
FIG. 9 is a sectional view taken along the line 9-9 in FIG. 8.

FIG. 8 is a top plan view of a heat generating resistor unit of a thermal head according to a third embodiment of the present invention. FIG. 9 is a sectional view taken along the line 9-9 in FIG. 8.

In this embodiment, a thermal conductor 19 is formed on a protecting film 15 of a plurality of heat generating resistors 14, in opposition to each of the heat generating resistors 14.

The thermal conductor 19 needs to quickly transfer thermal energy generated by the heat generating resistor 14 to a printing medium such as an ink sheet, and can be formed from a material having a large thermal conductivity. Further, the thermal conductor 19 contacts directly the printing medium and thus requires abrasion resistance. As a target for thermal conductivity, the thermal conductor 19 can have a thermal conductivity larger than that of the protecting film 15 so that heat transfer of the thermal conductor 19 is not limited when heat generated by the heat generating resistor 14 is transferred to the printing medium.

In terms of the above, metal materials, such as Ta having a thermal conductivity of 52 W/m·K, Mo having a thermal conductivity of 138 W/m·K and W having a thermal conductivity of 154 W/m·K and alloy materials thereof having a large thermal conductivity and high mechanical strength, can be used as a material of the thermal conductor 19.

Non-metal materials such as SiC having a thermal conductivity of 98 W/m·K having a large thermal conductivity and high abrasion resistance may also be used.

The thermal conductor 19 can be formed by an etching technique using photolithography, and can be formed to have an arbitrary pattern and an appropriate shape according to a printing characteristic. The thermal conductor has a rectangular shape in FIG. 8 but may have an oval shape. All thermal conductors do not need to have the same shape and size, though not illustrated. The thermal conductor may be larger or smaller than the heat generating resistor, and can be formed to have a desired pattern according to a required printing characteristic.

Adjacent thermal conductors are desirably formed separately so as to prevent mixing of thermal energy thereof.

The height of the thermal conductor 19 can be controlled by the film thickness of a thermal conductor material.

For example, a film having an arbitrary height can be formed by a sputtering technique. In this case, the thermal conductor 19 contacts directly the printing medium. Thus, an outermost surface thereof protrudes upwardly rather than the protecting film 15 on the wiring 13, thereby allowing satisfactory contact with the printing medium and improving printing efficiency.

The amount of protrusion of the thermal conductor 19 can be controlled by a film thickness of the thermal conductor material, and can be set according to a required printing characteristic.

One end of each heat generating resistor 14 is connected to a wiring 13 connecting to a common electrode 16, and the other end is connected to a wiring 13 connecting to a driver circuit unit (not shown).

An example is herein illustrated in which the common electrode 16 and the driver circuit unit (not shown) are disposed on opposite sides of the thermal insulating layer 9, but the heat generating resistor 14 or the wiring 13 may be folded back so that the common electrode 16 and the driver circuit unit are disposed on one side of the thermal insulating layer 9.

The above described configuration provides the thermal conductor 19 with abrasion resistance and a thermal conductivity to reduce the thickness of the protecting film 15. The reduction in thickness of the protecting film 15 formed from an insulating material such as $SiO_2$ or $Si_3N_4$ generally having a small thermal conductivity improves the increases in printing efficiency and printing speed. The thermal energy generated by the heat generating resistor is quickly transferred to the printing medium through the thin protecting film and the thermal conductor having a large thermal conductivity, thereby increasing the printing speed. Further, the increase in the printing speed reduces the amount of thermal energy generated by the heat generating resistor that escapes toward a heat sink, thereby reducing power consumption.

Next, a thermal printer using the thermal head according to the above described embodiments will be described.

The thermal printer according to this embodiment uses a sublimation thermal transfer recording system in a printer unit thereof, and prints images represented by electronic image information on an arbitrary number of papers. Such a thermal printer is described in Japanese Patent Application Laid-Open No. 2002-254686.

Figure 10:
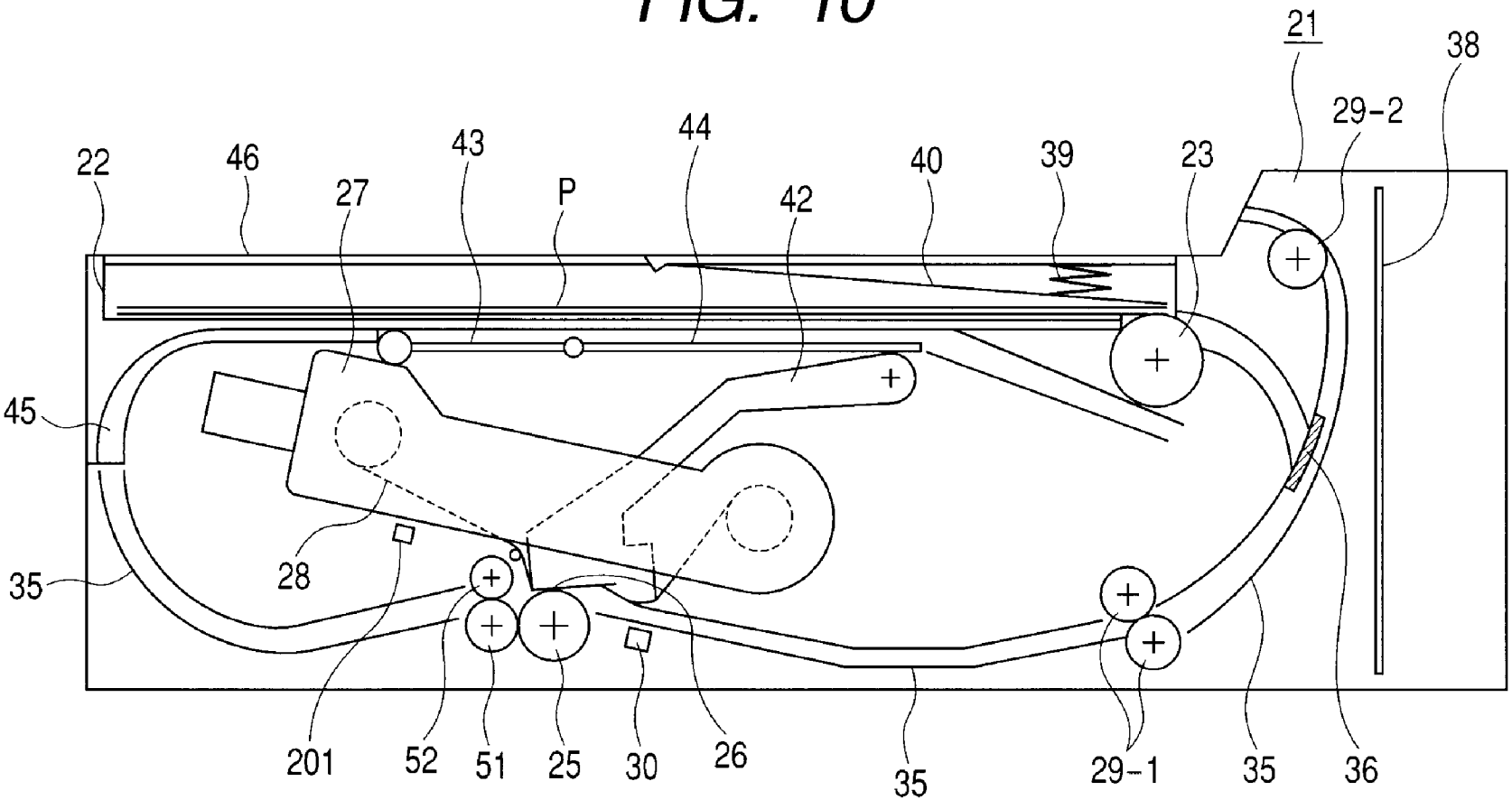
FIG. 10 is a sectional view of a thermal printer according to an embodiment of the present invention.

FIG. 10 is a sectional view of the thermal printer according to an embodiment of the present invention.

A control circuit 38 in a body 21 of the thermal printer includes a CPU, a RAM and a ROM, and controls configurations of the body 21, described later, to perform processes and operations described later.

Pieces of recording paper P that are recording media are stacked in a paper cassette 22, are abutted against a paper feed roller 23 by a push-up plate 40 urged by a spring 39, are separated one by one by the paper feed roller 23, and are supplied to a recording unit via a guide 35. A grip roller 51 and a pinch roller 52 that are a pair of rollers disposed in the recording unit hold and convey the supplied recording paper P to allow the recording paper P to be reciprocated in the recording unit.

In the recording unit, a platen roller 25 and a thermal head 26 are disposed to face each other on opposite sides of a conveying path of the recording paper. An ink sheet 28 is housed in a cassette 27. The ink sheet 28 has an ink layer on which hot-melt or thermal sublimation ink is applied and an overcoat layer coated over a print surface to protect the print surface. The thermal head 26 presses the ink sheet 28 onto the recording paper P, and heat generating elements of the thermal head 26 are selectively driven to generate heat to transfer ink onto the recording paper P and transfer and record images. A protecting layer is coated over the transferred image.

The ink sheet 28 has a width substantially equal to that of a print region of the recording paper P (a region perpendicular to a conveying direction). In a longitudinal direction of the ink sheet 28, ink layers of yellow (Y), magenta (M) and cyan (C) of a size substantially equal to that of the print region (the region in the conveying direction) and an overcoat (OP) layer are successively arranged alternatingly. Thus, thermal transfer of one layer at a time is performed, then the recording paper P is returned to a recording start position, and then thermal transfer of the next layer is performed, thereby allowing the four layers to be successively transferred (superimposed) onto the recording paper P. In other words, the recording paper P is reciprocated at a transfer position the number of times corresponding to the total number of ink colors and the overcoat layers by the pair of rollers 51 and 52.

The recording paper P after printing is reversed in its conveying direction and guided rearwardly of the body 21 by the guide 35 on the front of the body 21 (on the left in FIG. 10) and a paper conveying guide 45 provided in a lower front portion of the paper cassette 22. The recording paper P after printing is reversed on the front of the body 21, and thus the recording paper P during printing is not placed outside the body 21. This prevents waste of space to save space for placement of the apparatus, and also prevents the recording paper P from being unintentionally touched. Also, the structure in which the lower portion of the paper cassette 22 is directly used as a part of the guide can reduce the thickness of the body 21. Further, the recording paper P is passed through a space between the cassette 27 and the paper cassette 22, thereby minimizing a height of the body 21 and reducing the size of the apparatus.

After printing, the recording paper P conveyed rearwardly of the body 21 is guided by pairs of delivery rollers 29-1 and 29-2 from the rear to the front of the body 21 and delivered to a paper output tray 46. The pair of delivery rollers 29-1 are configured to be brought into pressure contact with each other just during delivery of the recording paper P so as not to apply stress to the recording paper P during printing. An upper surface of the paper cassette 22 also serves as a tray for the recording paper P delivered after printing, and this also reduces the size of the apparatus.

A conveying path switching sheet 36 switches the conveying path so as to guide the recording paper P to a delivery path after the recording paper P is supplied to the recording unit.

The thermal head 26 is integrated with a head arm 42, and in replacement of the cassette 27, the thermal head 26 is retracted to a position in which the cassette 27 can be removed without trouble. The cassette 27 can be replaced by withdrawing the paper cassette 22. Specifically, the head arm 42 is pressed by a cam portion of the paper cassette 22, but as the cam portion is retracted by withdrawing the paper cassette 22, the head arm 42 is retracted upwardly to allow replacement of the cassette 27. Front end detection sensor 30 detects a front end of a paper. Head covers 43 and 44 cover the thermal head.

The present invention can be applied to a printing apparatus such as a sublimation printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-221674, filed Aug. 29, 2008, which is hereby incorporated by reference herein in its entirety.

What is claimed is:

1. A thermal head comprising:

a plurality of heat generating resistors;

a driver circuit unit configured to drive the plurality of heat generating resistors to generate a heat;

a wiring configured to connect the driver circuit unit to the plurality of heat generating resistors;

a passivation film formed to cover the plurality of heat generating resistors, the driver circuit unit and the wiring, wherein the plurality of heat generating resistors, the driver circuit unit, the wiring and the passivation film are formed on a common semiconductor substrate, and wherein a silicon oxide film is arranged between the heat generating resistor and the semiconductor substrate, and a thermal insulating layer having a thermal conductivity smaller than that of the silicon oxide film and having a shape protruding from the substrate toward the heat generating resistor is arranged between the heat generating resistor and the silicon oxide film.

2. The thermal head according to claim 1, wherein the thermal insulating layer has a thermal conductivity smaller than 0.5 W/m·K, and has a maximum thickness of larger than 10 μm at the protruding shape.

3. The thermal head according to claim 1, wherein an insulating layer is disposed on the thermal insulating layer, such that the thermal insulating layer is sandwiched between the insulating layer and the silicon oxide film.

4. The thermal head according to claim 1, wherein the thermal insulating layer has a sectional area shaped to form at least one curvature.

5. The thermal head according to claim 1, wherein the thermal insulating layer is not disposed in a gap between the plurality of heat generating resistors.

6. The thermal head according to claim 1, wherein the thermal insulating layer is disposed in a gap between the plurality of heat generating resistors, and the thickness of the thermal insulating layer disposed in the gap is smaller than the thickness of the thermal insulating layer at just under the heat generating resistors.

7. The thermal head according to claim 1, wherein a thermal conductor having a thermal conductivity larger than that of the protecting film is disposed on the passivation film of each of the plurality of heat generating resistors.

8. The thermal head according to claim 1, wherein the substrate is formed from a single crystalline silicon.

9. A thermal printer comprising:

a thermal head according to claim 1, wherein the thermal head transfers an ink from an ink sheet to a recording medium for recording.

* * * * *